US009155350B2

(12) United States Patent
Chapin et al.

(10) Patent No.: US 9,155,350 B2
(45) Date of Patent: Oct. 13, 2015

(54) SYSTEMS AND METHODS FOR IMPROVED CUSTOMIZABLE, EMBELLISHED FOOTWEAR

(75) Inventors: Chris Chapin, Mesa, AZ (US); Dana Chapin, Mesa, AZ (US)

(73) Assignee: Tizzi, Inc., Mesa, AZ (US)

( * ) Notice: Subject to any disclaimer, the term of this patent is extended or adjusted under 35 U.S.C. 154(b) by 205 days.

(21) Appl. No.: 13/469,449

(22) Filed: May 11, 2012

(65) Prior Publication Data

US 2012/0285046 A1 Nov. 15, 2012

Related U.S. Application Data

(60) Provisional application No. 61/485,462, filed on May 12, 2011.

(51) Int. Cl.

| | |
|---|---|
| ***A43B 3/24*** | (2006.01) |
| ***A43B 23/00*** | (2006.01) |
| ***A43B 3/00*** | (2006.01) |
| ***A43B 3/12*** | (2006.01) |
| ***A43C 5/00*** | (2006.01) |
| ***A44B 1/04*** | (2006.01) |
| ***A43B 3/10*** | (2006.01) |
| ***A43B 23/24*** | (2006.01) |

(52) U.S. Cl.

CPC ..... *A43B 3/0078* (2013.01); *A43B 3/103* (2013.01); *A43B 3/12* (2013.01); *A43B 3/122* (2013.01); *A43B 23/24* (2013.01); *A43C 5/00* (2013.01); *A44B 1/04* (2013.01)

(58) Field of Classification Search

CPC ..... A43B 23/24; A43B 23/25; A43B 3/0047; A43B 3/0078; A43B 3/0084; A43B 3/12; A43B 3/28; A43B 3/30; A44B 17/0035; A44B 17/0029; A44B 13/0058; A44B 13/0064; A44B 13/0076; A44B 13/001; A44B 13/04; A44B 13/08; A44B 1/04; Y10D 24/51; A44C 5/00

USPC ..... 36/100, 101, 136, 11.5; 2/10, 23, 56, 2/249, 251, 252; 40/315; 63/20; 24/1, 24/578.13, 703.1

See application file for complete search history.

(56) References Cited

U.S. PATENT DOCUMENTS

| | | | | | |
|---|---|---|---|---|---|
| 1,589,158 | A | * | 6/1926 | Hedison | 63/20 |
| 1,721,819 | A | * | 7/1929 | Hughes | 24/713.7 |
| 1,821,428 | A | * | 9/1931 | Fenton | 24/703.1 |
| 1,934,653 | A | * | 11/1933 | Arthur | 24/90.5 |
| 2,239,324 | A | * | 4/1941 | Hills | 24/713.7 |
| 3,011,281 | A | | 12/1961 | King | |
| 3,141,211 | A | * | 7/1964 | Blake | 24/114.9 |
| 4,097,934 | A | * | 7/1978 | Weinstein | 2/195.1 |
| 4,247,958 | A | * | 2/1981 | Gallin | 2/171.1 |
| 4,543,740 | A | * | 10/1985 | Moriarity et al. | 40/315 |
| 4,864,736 | A | * | 9/1989 | Bierk | 36/11.5 |
| 5,496,612 | A | | 3/1996 | Ransbottom | |
| 5,673,501 | A | * | 10/1997 | Mathews | 36/136 |
| 6,769,204 | B1 | | 8/2004 | Phillips | |
| D540,514 | S | * | 4/2007 | Hendricks | D2/916 |
| D570,088 | S | * | 6/2008 | Lee | D2/969 |

(Continued)

*Primary Examiner* — Jila M Mohandesi
*Assistant Examiner* — Katharine Gracz
(74) *Attorney, Agent, or Firm* — The Noblitt Group, PLLC

(57) ABSTRACT

In various embodiments, the footwear comprises a sandal or a flip flop and the eyelet may be located anywhere on the footwear, for example on a strap. In some exemplary embodiments, an embellishment extends over one or more straps of the footwear without being coupled at the eyelet.

15 Claims, 11 Drawing Sheets

(56) References Cited

U.S. PATENT DOCUMENTS

| | | | | |
|---|---|---|---|---|
| D604,940 | S | 12/2009 | Collier | |
| 2004/0093765 | A1 | 5/2004 | Baldwin | |
| 2006/0007668 | A1* | 1/2006 | Chien | 362/103 |
| 2007/0006502 | A1* | 1/2007 | Schmelzer et al. | 40/636 |
| 2007/0094776 | A1* | 5/2007 | Stevens et al. | 2/338 |
| 2007/0220777 | A1* | 9/2007 | Richardson | 36/11.5 |
| 2007/0245597 | A1* | 10/2007 | Krutilek et al. | 36/101 |
| 2008/0127525 | A1 | 6/2008 | Blunden et al. | |
| 2009/0188442 | A1* | 7/2009 | Dawe | 119/792 |
| 2009/0300948 | A1 | 12/2009 | Nordstrom-Wehner | |
| 2010/0011623 | A1 | 1/2010 | Seckler et al. | |
| 2010/0307026 | A1 | 12/2010 | Andrews | |

* cited by examiner

SYSTEMS AND METHODS FOR IMPROVED CUSTOMIZABLE, EMBELLISHED FOOTWEAR

CROSS-REFERENCE TO RELATED APPLICATIONS

This application claims priority to U.S. Provisional Patent Application Ser. No. 61/485,462 filed on May 12, 2011 and entitled "Systems and Methods for Improved Customizable, Embellished Footwear," which is incorporated herein by reference in its entirety.

FIELD OF INVENTION

The present disclosure generally relates to systems and methods for improved customizable, embellished footwear.

BACKGROUND OF THE INVENTION

Consumers are ever searching for footwear that is comfortable, that matches outfit color schemes, that is of an appropriate dressiness (casual, fancy, etc.), that is suitable for various types of weather, that is in keeping with the latest fashions and trends, etc. Meeting all of these demands requires consumers spend an inordinate amount of money on footwear that may only be used occasionally.

Thus, others have developed customizable footwear that can be used for multiple occasions, with only the attachment or detachment of embellishments. However, others' footwear suffers from many defects. For example the embellishments may rotate out of the proper orientation, the footwear may not be worn without the embellishments, the embellishments may cause discomfort, and others.

There is thus a need in the art for improved customizable, embellished footwear. The present invention addresses this need.

SUMMARY OF THE INVENTION

In accordance with exemplary embodiments, the present disclosure comprises footwear having one or more eyelets through which a backing element and a decorative top engage each other.

The footwear preferably comprises a sandal or a flip flop and the eyelet may be located anywhere on the footwear, preferably on a strap, The eyelet may be configured to receive a decorative element. The eyelet may have a frame comprising one or more internal non-elliptical features forming an internal perimeter of the eyelet frame such as one or more internal polygonal features comprising at least three internal straight sides configured to engage one or more external geometric features (e.g. a polygonal feature comprising at least three external straight sides or any other external non-elliptical or non-circular shape or feature) of one or both of the backing element and the decorative top (for example a post of the decorative element) to prevent unwanted rotation of the decorative top. A notch and groove type configuration between the eyelet and one or both of the backing element and the decorative element and/or weight distribution of the decorative element may also be used to prevent unwanted rotation and thereby maintain the decorative top's desired orientation. Similarly, the decorative top may be configured with an indexing feature. The indexing feature may be integral with the post protruding from the bottom of the decorative element. The indexing feature may also be coupled to or integrally formed in the decorative top. The indexing feature may be configured to engage a plurality of indexing holes, such that the decorative element may be positioned in various orientations. In exemplary embodiments, the eyelet may itself have decorative characteristics such that the footwear may be worn without the backing element and the decorative top.

The backing element and the decorative top may engage each other threadably or with one or more snaps, clips or the like. Magnetism may also be used. The backing element may also have a smooth, rounded and/or soft external surface to provide added comfort to the wearer.

In exemplary embodiments, the decorative top itself is an embellishment or is coupled to an embellishment. Exemplary embellishments may comprise crosses, stars, flowers, logos, and the like.

In yet other exemplary embodiments, an embellishment is layered between the eyelet and the decorative top and may have an eyelet substantially similar to the footwear's eyelet.

In still other exemplary embodiments, an embellishment layered between the eyelet and the decorative top extends over one or more straps of the footwear. The embellishment may be connected around the strap with any suitable fastener, including for example, Velcro®, one or more snaps, clips or the like. In some exemplary embodiments, an embellishment extends over one or more straps of the footwear without being coupled at the eyelet.

BRIEF DESCRIPTION OF THE DRAWINGS

The exemplary embodiments of the present invention will be described in conjunction with the accompanying drawing figures in which like numerals denote like elements and.

DETAILED DESCRIPTION

Figure 1:
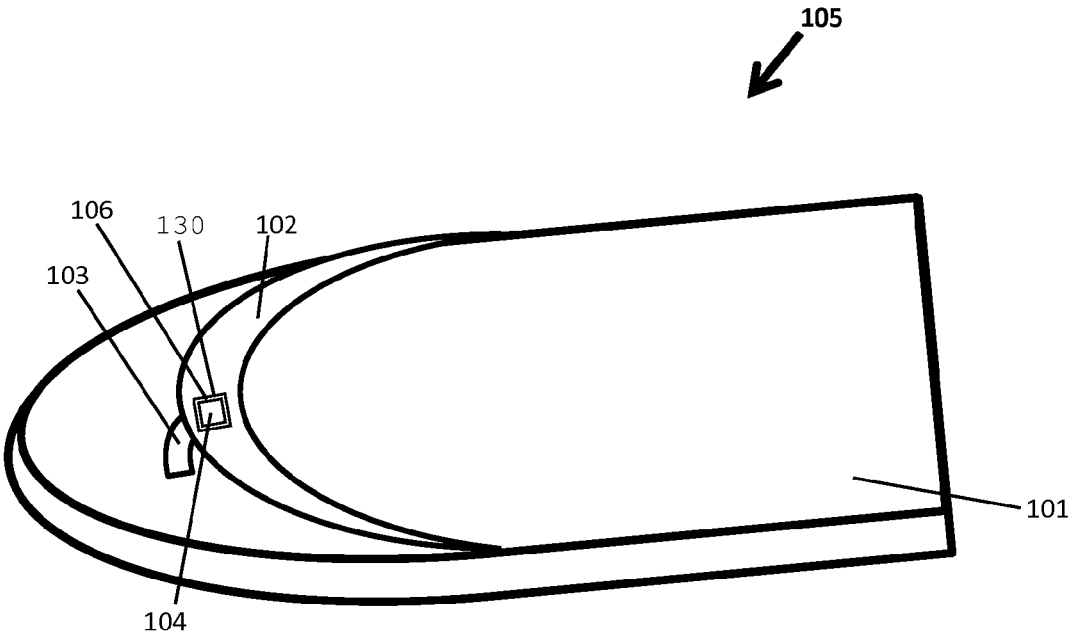
FIG. 1 illustrates top view of sandal/flip flop showing attached eyelet.

Persons skilled in the art will readily appreciate that various aspects of the present invention may be realized by any number of methods and apparatuses configured to perform the intended functions. Stated differently, other methods and apparatuses may be incorporated herein to perform the intended functions. It should also be noted that the accompanying drawing figures referred to herein are not all drawn to scale, but may be exaggerated to illustrate various aspects of the present invention, and in that regard, the drawing figures should not be construed as limiting. Finally, although the present invention may be described in connection with various principles and beliefs, the present invention should not be bound by theory.

In an exemplary embodiment and with reference to FIG. 1, sandal/flip flop 105 comprises a sole 101, a strap 102, a thong 103 and an eyelet 104 comprising a stationary eyelet frame 106. Sandal/flip flop 105 may be designed in various ways. For example, sole 101 may be a wedge bottom, a heel bottom or a flat bottom. Sandal/flip flop 105 may fasten to a foot by strap 102 and/or thong 103. In various embodiments, sandal/flip flop 105 comprises one thin strap 102. However, in various embodiments, sandal/flip flop 105 may comprise any number of straps 102. Strap 102 may vary in size. Eyelet 104 may comprise a stationary eyelet frame 106. In various embodiments, eyelet 104 is substantially square shaped. However, eyelet 104 and stationary eyelet frame 106 may be any shape, including, for example a triangle, a rectangle, a diamond or any other suitable shape. Stationary eyelet frame 106 may vary in material and size. In various embodiments, stationary eyelet frame 106 is a metal material. However, stationary eyelet frame 106 may be any material, including, for example a plastic, a rubber, aluminum, a brass, a copper, a metal or any combination of these or other suitable durable material, to form stationary eyelet frame 106. Eyelet 104 may be located at an attachment point anywhere on sandal/flip flop 105. In various embodiments, sandal/flip flop 105 includes one eyelet 104 in the center of strap 102. However, sandal/flip flop 105 may comprise any number of eyelets 104. Eyelet 104 may be designed in various ways. For example, eyelet 104 may be a prong eyelet, an eyelet, a screw eyelet, a grommet, a screw grommet, a snap, a screw rivet, a hollow rivet, a rivet, a button hole, a button, a cut out shape, a threaded hole, a hollow opening, or any combination of these or other suitable embellishments, or any other mechanisms. In various embodiments, stationary eyelet frame 106 is two pieces. However, stationary eyelet frame 106 may comprise any number of pieces.

Figure 2:
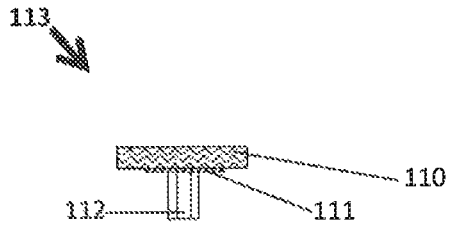
FIG. 2 illustrates side view of decorative top.

In an exemplary embodiment and with reference to FIG. 2, sandal/flip flop 105 may be configured to removably couple to a decorative top 113. Decorative top 113 includes an ornament 110, a mounting plate 111, and a post 112. Decorative top 113 is used to customize and enhance an entire fashionable look. Ornament 110 may vary in size, shape and/or material. In various embodiments, ornament 110 is a jewel. However, ornament 110 may be an acrylic stone, a bead, a butterfly, a button, a charm, a letter, a number, a phrase, a symbol, a shape, a rhinestone, a feather, ribbon, or any combination of these or other embellishments, to accessorize sandal/flip flop 105. Mounting plate 111 may be used to connect ornament 110 and post 112 as one piece. In various embodiments, mounting plate 111 is a square shape. However, mounting plate 111 may vary in size and shape as noted above. In various embodiments, mounting plate 111 is a metal material. However, mounting plate 111 may be any material, including, for example plastic, rubber, aluminum, brass, copper, metal or any combination of these or other suitable durable material, to form mounting plate 111. In various embodiments, post 112 is a square shape used to stabilize rotation. However, post 112 may vary in shape, size and/or material. In an embodiment, post 112 is a metal material. However, post 112 may be any suitable material, including, for example plastic, rubber, brass, copper, aluminum, other suitable metals or any combination of these or other durable materials. In various embodiments, the fastener system of post 112 is threaded. However, in various embodiments, the fastener system of post 112 may be a button, a push button, a hook, a loop, a magnetic, a twist, a clip, a dowel, a tie, a spring, a pin, a prong, a screw, a lock, a key, or any combination of these or other mechanisms, or any other suitable releasable mechanism, to connect decorative top 113. In various embodiments, ornament 110 may connect to post 112 as one piece. However, decorative top 113 may use glue, a weld, a mold or any combination of these or any other adhesive used to connect ornament 110 to post 112.

Figure 3:
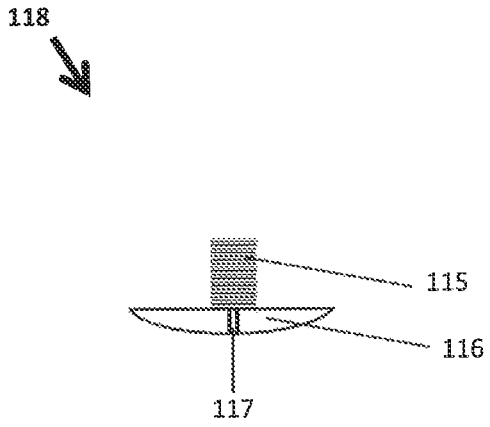
FIG. 3 illustrates side view of backing element.

With reference to FIG. 3, ornament 110 comprises a backing element 118. In an embodiment, backing element 118 is a magnetic metal material (e. g., copper). However, backing element 118 may be any suitable material, including, for example plastic, rubber, aluminum, brass, copper, or other suitable metal or any combination of these or other suitable durable material. Backing element 118 may include a threaded screw 115 at a first end, a head 116 at a second end, and a penny slot/notch 117. Threaded screw 115 may vary in size, shape and material. In various embodiments, threaded screw 115 twists and connects to post 112. However, in various embodiment, the fastener system of backing element 118 may be a button, a push button, a hook, a loop, a magnetic, a twist, a clip, a dowel, a tie, a spring, a pin, a prong, a screw, a lock, a key, or any combination of these or other mechanisms, or any other releasable mechanism, to connect decorative top 113 to backing element 118. In an embodiment, head 116 is a round dome shape. However, head 116 may vary in shape, size and material. Head 116 may be smooth. Head 116 may comprise a penny slot/notch 117. Penny slot/notch 117 may be used to tighten and fasten ornament 110 to sandal/flip flop 105. Further, penny slot/notch 117 may vary in shape and size.

Figure 4:
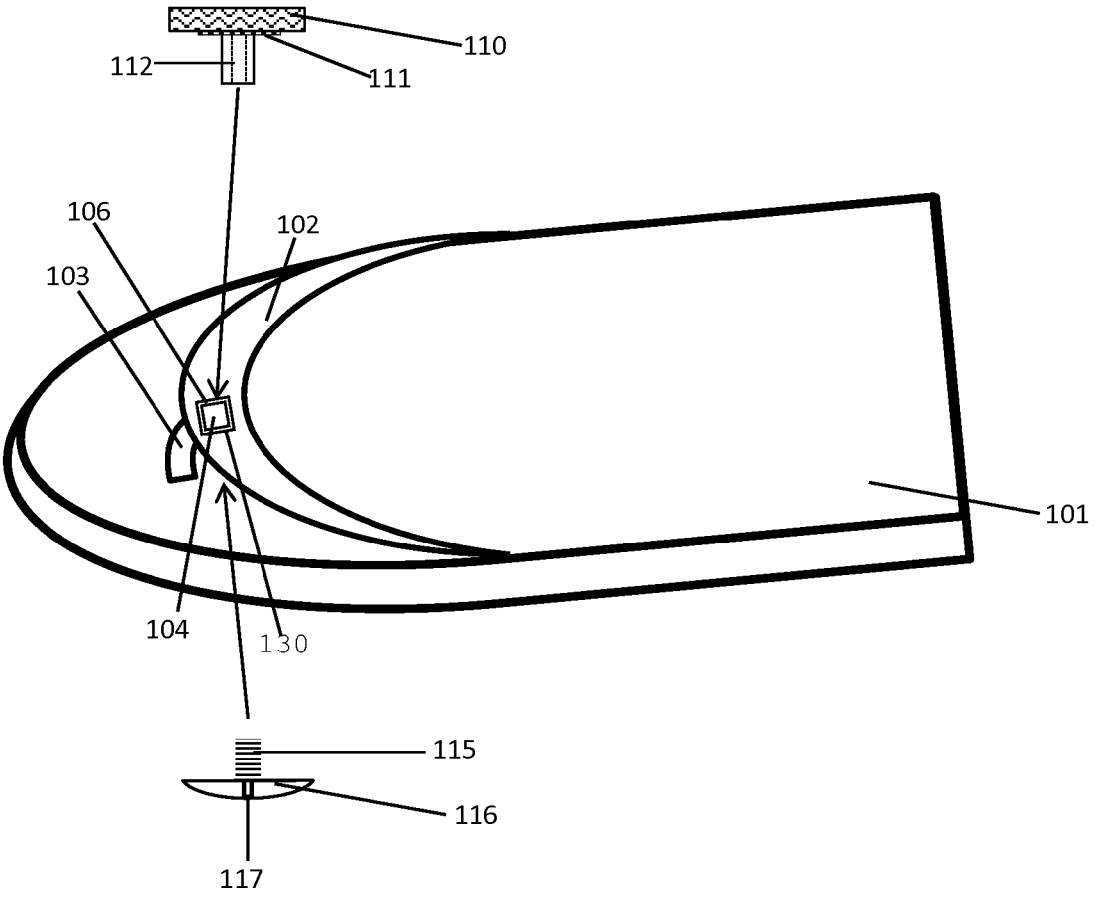
FIG. 4 illustrates top view of sandal/flip flop engaging decorative top and backing element.

With reference to FIG. 4, sandal/flip flop 105 may be configured to receive and removably couple to decorative top 113 and backing element 118 through eyelet 104 located on strap 102 of sandal/flip flop 105. Eyelet 104 and stationary eyelet frame 106 may have one or more internal polygonal features configured to engage one or more external geometric features (e.g. a polygonal feature) of one or both of backing element 118 and decorative top 113 (for example post 112 of decorative top 113) to prevent unwanted rotation of decorative top 113. Eyelet 104 may be a prong eyelet, an eyelet, a screw eyelet, a grommet, a screw grommet, a snap, a screw rivet, a hollow rivet, a rivet, a button hole, a button, a cut out shape, a threaded hole, a hollow opening, or any combination of these or other suitable embellishments, or any other embellishment mechanisms, used at least in part to fix rotation of decorative top 113. In various embodiments, stationary eyelet frame 106 is two pieces. However, stationary eyelet frame 106 may comprise any number of pieces.

In various embodiments a penny is used to tighten and secure decorative top 113 (e.g. apply a torque to the decorative top) to minimize rotation of decorative top 113 with respect to sandal/flip flop 105. However, one may use a dime, a screw driver, or other suitable tools to tighten the decorative element to sandal/flip flop 105. When connected, decorative top 113 may be fixed, such that decorative top 113 does not rotate. Similarly, decorative top 113 may be removed by using a penny and twist backing element 118 such that decorative top 113 is uncoupled from sandal/flip flop 105.

Figure 5:
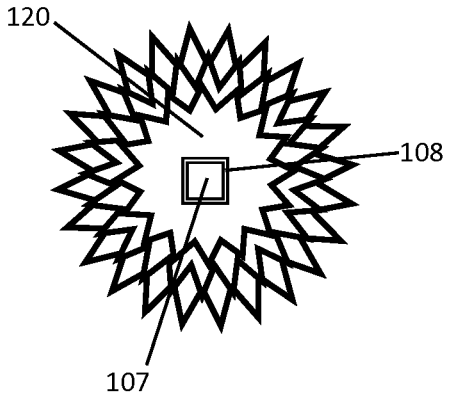
FIG. 5 illustrates top view of flower with eyelet.

With reference to FIG. 5, sandal/flip flop 105 may comprise an embellishment such as a flower 120. Flower 120 may include eyelet 107 that comprises a sliding eyelet frame 108. In various embodiments, flower 120 is a cotton material. However, flower 120 may be a polyester, a satin, a spandex, a lace, an elastic, a ribbon or any combination of these or any other suitable materials. In an embodiment, flower 120 may comprise three black and three white layers of material. However, flower 120 may vary in layers and colors. In various embodiments, flower 120 may have a circular shape. However, flower 120 may be any suitable shape and size. Flower 120 may include eyelet 107 at the center of flower 120. Eyelet 107 may vary in shape, size and material. Sliding eyelet frame 108 may have one or more internal polygonal features configured to engage one or more external geometric features (e.g. a polygonal feature) of one or both of backing element 118 and decorative top 113 (for example post 112 of decorative top 113) to prevent unwanted rotation of flower 120. Eyelet 107 may be a prong eyelet, an eyelet, a screw eyelet, a grommet, a screw grommet, a snap, a screw rivet, a hollow rivet, a rivet, a button hole, a button, a cut out shape, a threaded hole, a hollow opening, or any combination of these or other suitable embellishments, or any other embellishment mechanisms, used at least in part to fix rotation of flower 120. In various embodiments, sliding eyelet frame 108 is two pieces. However, sliding eyelet frame 108 may comprise any number of pieces.

Figure 11:
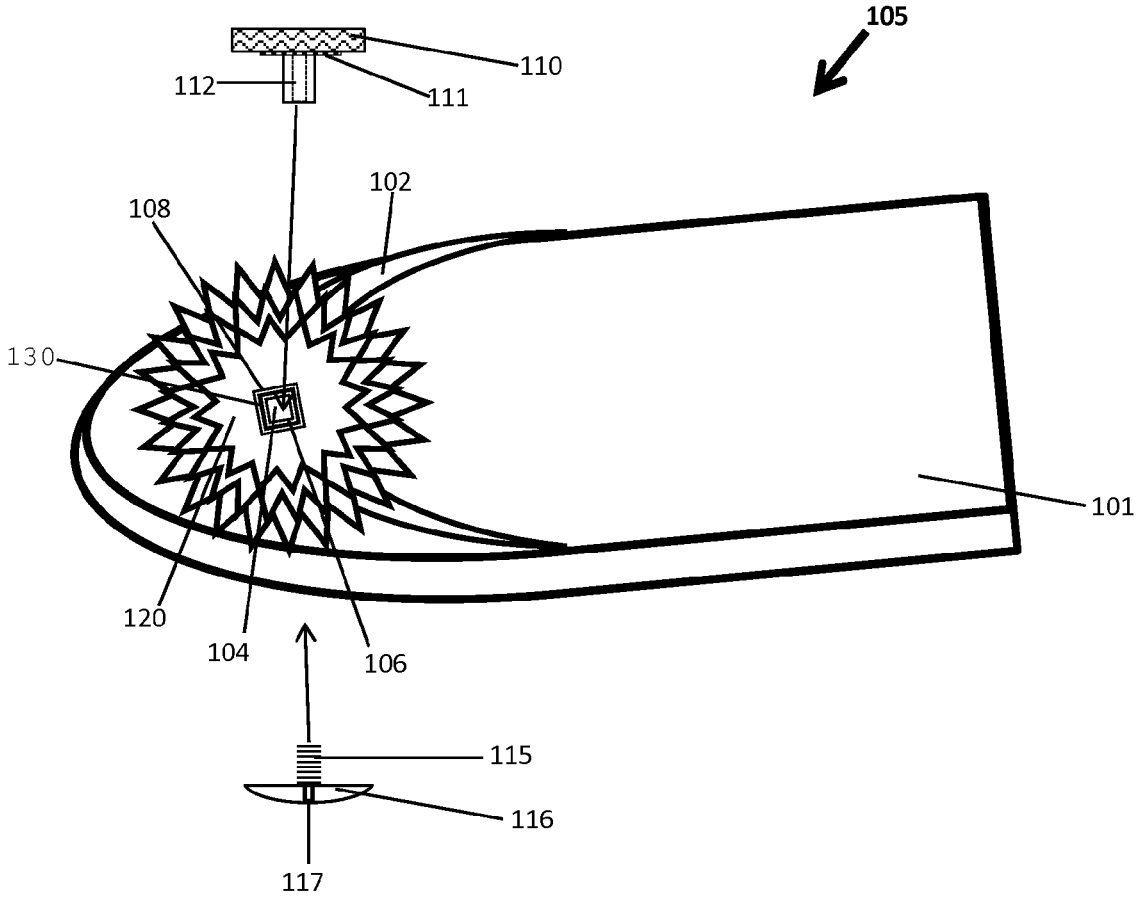
FIG. 11 illustrates a top view of the sandal/flip flop of FIG. 4 engaging with the flower embellishment of FIG. 5.

In operation, flower 120 may removably attach to sandal/flip flop 105 in various ways. For example, flower 120 may attach by sliding eyelet 107 comprising sliding eyelet frame 108 of flower 120 along post 112 located on decorative top 113 and by sliding post 112 of decorative top 113 through eyelet 104 comprising stationary eyelet frame 106 located on strap 102 of sandal/flip flop 105. Flower 120 may be retained by connecting and tightening backing element 118. However, in another embodiment, as shown in FIG. 11, flower 120 may attach by sliding eyelet 107 comprising sliding eyelet frame 108 of flower 120 around eyelet 104 comprising stationary eyelet frame 106 located on strap 102 of sandal/flip flop 105 such that sliding eyelet frame 108 is seated around an outer perimeter 130 of stationary eyelet frame 106. Decorative top 113 is configured to slide post 112 through eyelet 104 comprising stationary eyelet frame 106 located on strap 102 of sandal/flip flop 105. Flower 120 may be retained by connecting and tightening backing element 118.

Figure 6:
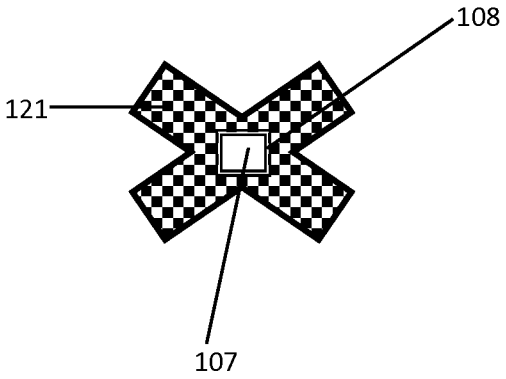
FIG. 6 illustrates top view of bow with eyelet.

In an embodiment and with reference to FIG. 6, sandal/flip flop 105 may be configured to removably couple to an embellishment such as a bow 121. Bow 121 comprises eyelet 107, which comprises a sliding eyelet frame 108. In various embodiments, bow 121 is made of a ribbon material. However, bow 121 may be a polyester, a satin, a spandex, a lace, an elastic, a cotton or any combination of these or any other suitable material. In one example, bow 121 is shown with two black and white layers of material. However, bow 121 may be configured with any number of layers and in any color(s), In various embodiments, bow 121 is shown in a cross shape. However, bow 121 may be of any suitable shape and size. Bow 121 may include eyelet 107 at center of bow 121. Eyelet 107 may vary in shape, size and material. Sliding eyelet frame 108 may have one or more internal polygonal features configured to engage one or more external geometric features (e.g. a polygonal feature) of one or both of backing element 118 and decorative top 113 (for example post 112 of decorative top 113) to prevent unwanted rotation of bow 121. Eyelet 107 may be a prong eyelet, an eyelet, a screw eyelet, a grommet, a screw grommet, a snap, a screw rivet, a hollow rivet, a rivet, a button hole, a button, a cut out shape, a threaded hole, a hollow opening, or any combination of these or other suitable embellishments, or any other embellishment mechanisms, used at least in part to fix rotation of bow 121. In various embodiments, sliding eyelet frame 108 is two pieces. However, eyelet 104 may comprise any number of pieces.

In operation, bow 121 may removably attach to sandal/flip flop 105 in various ways. For example, bow 121 may attach by sliding eyelet 107 comprising sliding eyelet frame 108 of bow 121 along post 112 located on decorative top 113 and by sliding post 112 of decorative top 113 through eyelet 104 comprising stationary eyelet frame 106 located on strap 102 of sandal/flip flop 105. Bow 121 may be retained by connecting and tightening backing element 118. However, in another embodiment bow 121 may attach by sliding eyelet 107 comprising sliding eyelet frame 108 of bow 121 around eyelet 104 located on strap 102 of sandal/flip flop 105 such that sliding eyelet frame 108 is seated around an outer perimeter 130 of stationary eyelet frame 106. Decorative top 113 is configured to slide post 112 through eyelet 104 comprising stationary eyelet frame 106 located on strap 102 of sandal/flip flop 105. Bow 121 may be retained by connecting and tightening backing element 118.

While FIGS. 5 and 6 illustrate embodiments of a flower and a bow respectively, any other embellishments comprising eyelet 107 may be used, for example, an acrylic stone, a bead, a butterfly, a button, a charm, a letter, a number, a phrase, a symbol, a shape, a rhinestone, a feather, ribbon, a strap, a wrap or any combination of these or other embellishments, to accessorize sandal/flip flop 105. In exemplary embodiments, a plurality of additional embellishments comprising eyelet 107 are used.

Figure 7:
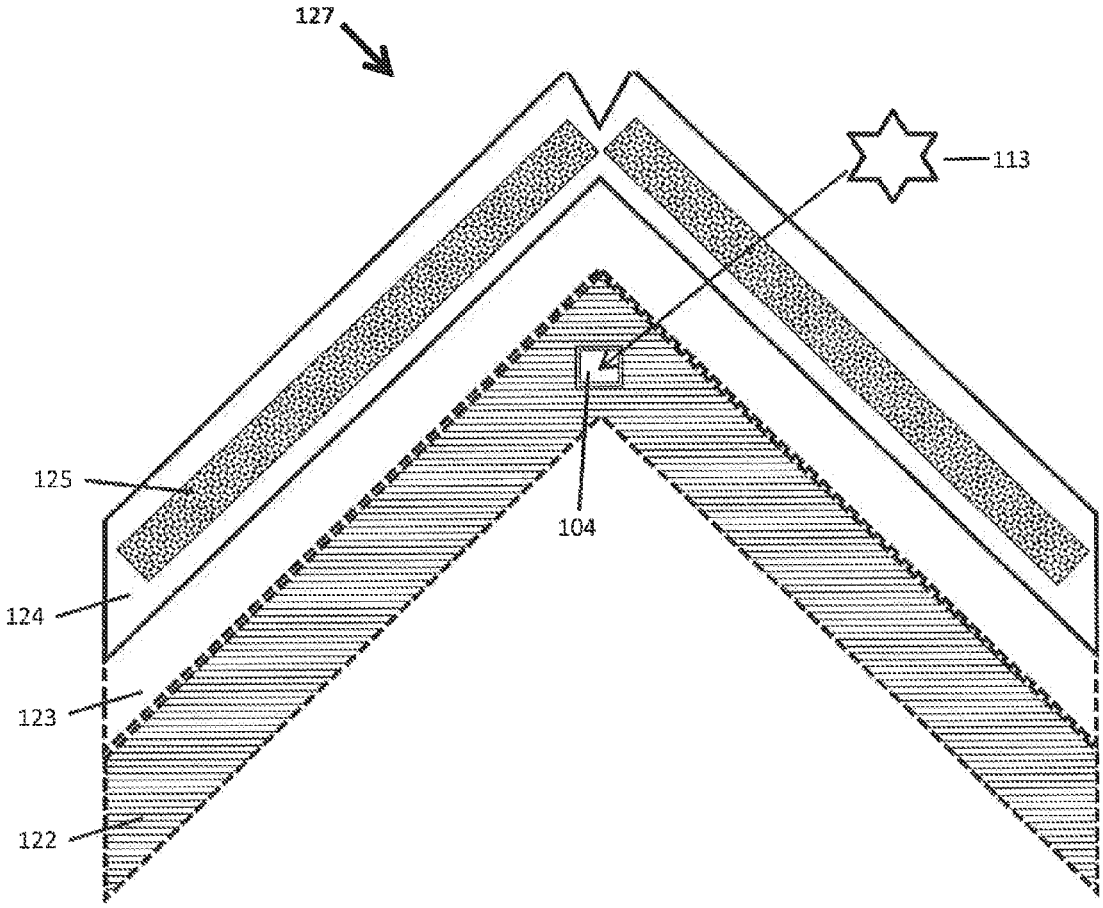
FIG. 7 illustrates top view of strap wrap with eyelet engaging decorative top.
Figure 8:
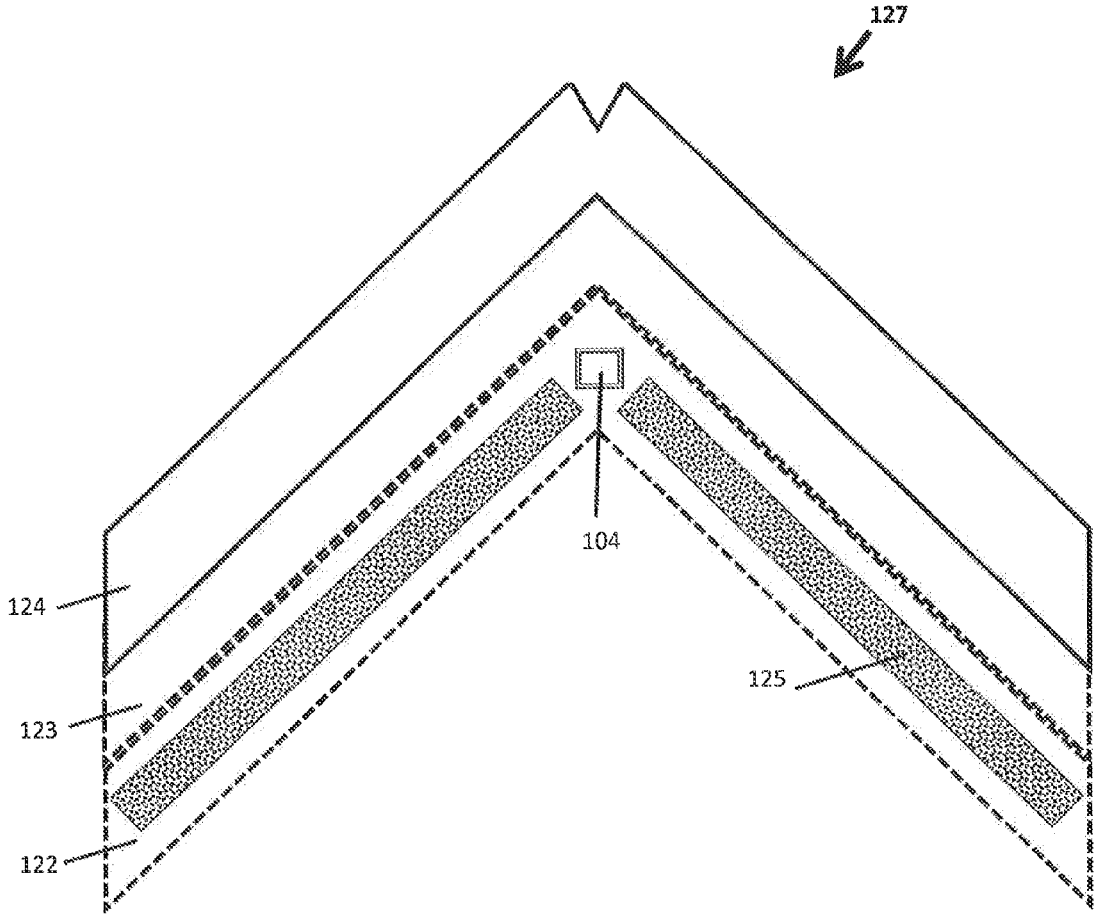
FIG. 8 illustrates bottom view of strap wrap with fastening system.

In an embodiment and with reference to FIG. 7, sandal/flip flop 105 may comprise a strap wrap 127 as an exemplary additional embellishment. Strap wrap 127 may include a decorative top strap cover 122, a bottom strap cover 123, an inner strap cover 124, an attachment system 125 and the eyelet 104. In various embodiments, strap wrap 127 is wrapped around existing strap 102 to change the appearance of strap 102. Strap wrap 127 may vary in size, shape, material and/or embellishments. In the illustrated embodiment, attachment system 125 comprises Velcro® used to secure strap wrap 127 around strap 102. However, attachment system 125 may comprise any fastener, including, for example a button, a push button, a hook, a loop, a magnetic, a twist, a clip, a dowel, a tie, a spring, a pin, a prong, a screw, a lock, a key, a zipper, or any combination of these or other mechanisms, or any other suitable releasable mechanism. In various of these embodiments, inner strap cover 124 may not be necessary.

Attachment system 125 may be configured to secure strap wrap 127 to itself around strap 102. Additionally, or in the alternative, attachment system 125 may be configured to secure strap wrap 127 at least in part to strap 102. Attachment system 125 may be positioned anywhere with reference to strap 102, for instance, in the middle, on the front, on the back, diagonal, on the bottom, and/or on the top.

In various embodiments, strap wrap 127 comprises eyelet 104. Eyelet 104 may be configured to receive interchangeable decorative top 113 and backing element 118 secured to sandal/flip flop 105 as described above. Eyelet 104 may have one or more internal polygonal features configured to engage one or more external geometric features (e.g. a polygonal feature) of one or both of backing element 118 and decorative top 113 (for example post 112 of decorative top 113) to prevent unwanted movement of strap wrap 127. Eyelet 104 may be a prong eyelet, a grommet, a hollow rivet, a button hole, a cut out shape or any other hollow opening used at least in part to fix movement of strap wrap 127.

In this manner, strap wrap 127 may also be secured to sandal/flip flop 105 to further embellish it. In a similar manner, strap wrap 127 and may be layered with other embellishments comprising eyelet 104, for example, flower 120, bow 121 and the like.

Figure 9:
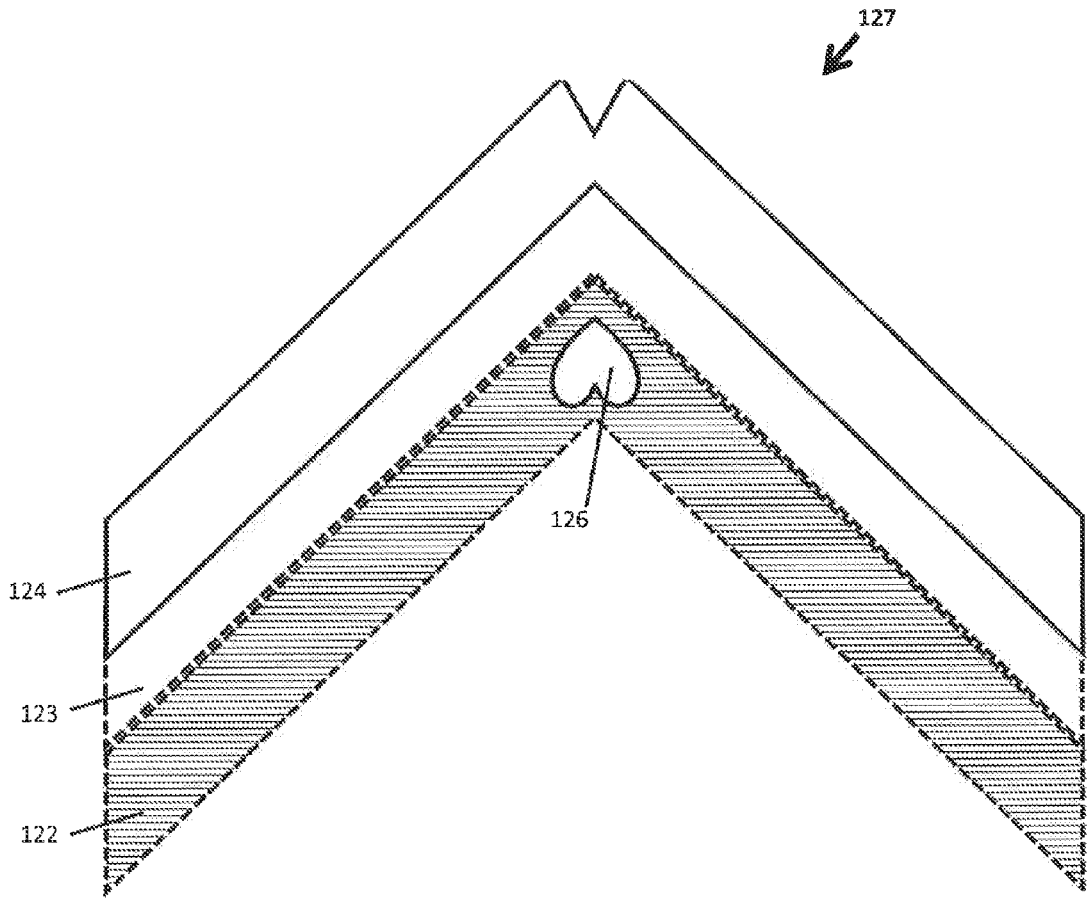
FIG. 9 illustrates top view of strap wrap with attached charm.

In an exemplary embodiment and with reference to FIG. 9, strap wrap 127 comprises a decorative top strap cover 122, a bottom strap cover 123, an inner strap cover 124, attachment system 125 and an attached charm 126. Charm 126 may be fixed in any suitable manner, such that when charm 126 is not allowed to move.

Figure 10:
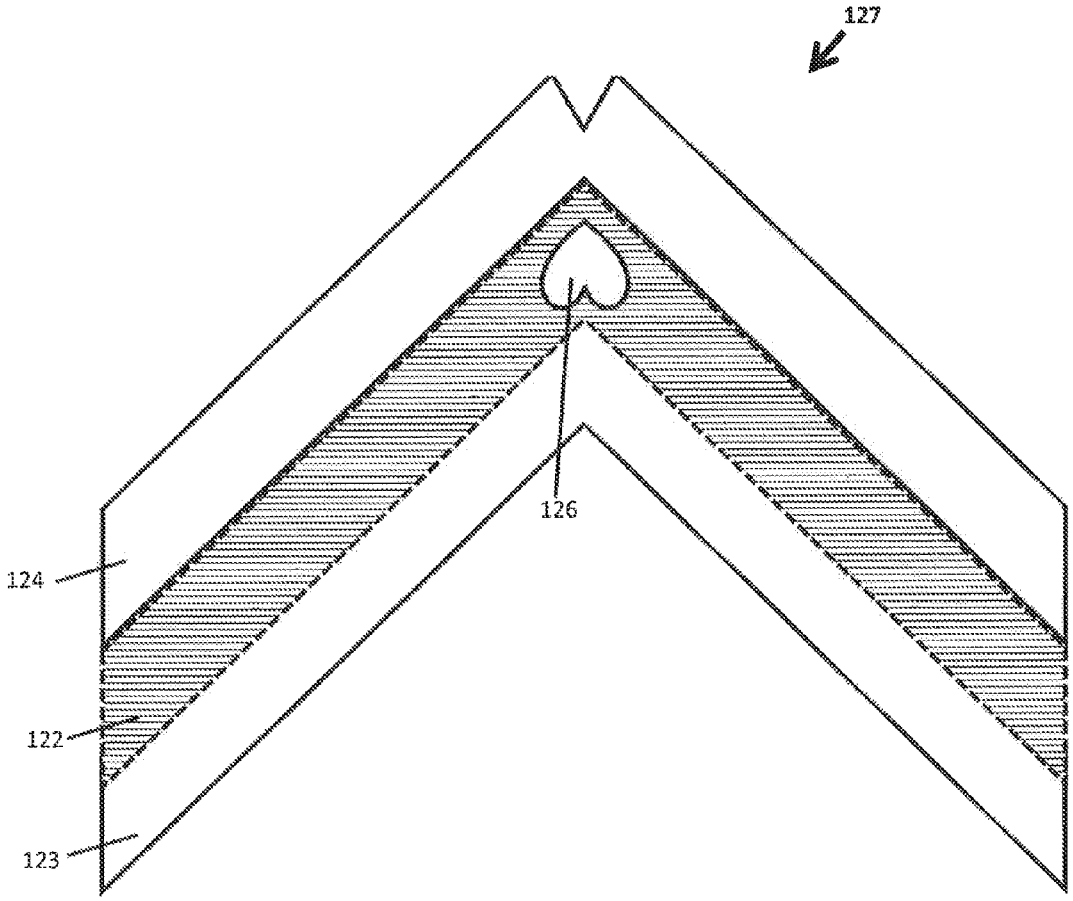
FIG. 10 illustrates yet another top view of strap wrap with attached charm.

Finally, and with reference to FIG. 10, illustrated is strap wrap 127 with decorative top strap cover 122 located in the middle position. Decorative top strap cover 122 may vary in position, for instance, in the middle, on the bottom, and/or on the top. Both bottom strap cover 123 and inner strap cover 124 may similarly vary in position. As noted above, in various embodiments, inner strap cover 124 may not be necessary.

The foregoing disclosure is merely illustrative of the present invention and is not intended to be construed as limiting the invention. Although one or more embodiments of the present invention have been described, persons skilled in the art will readily appreciate that numerous modifications could be made without departing from the spirit and scope of the present invention. For example, the present invention may be used in connection with other footwear, other articles of clothing and accessories, for instance, hats, bags, belts, jewelry, etc. As such, it should be understood that all such modifications are intended to be included within the scope of the present invention.

We claim:

1. A system for customizable, embellished footwear comprising:

a decorative top comprising an ornament coupled to a post having at least three external straight sides;

a backing element comprising a threaded screw at a first end and a head at a second end, wherein the threaded screw threads into the post;

a sandal comprising a strap having a first stationary eyelet frame surrounding a cut out extending through the strap, wherein the first stationary eyelet frame comprises at least three internal straight sides, and wherein the at least three internal straight sides spatially correspond to the at least three external straight sides to prevent rotation of the decorative top when the decorative top engages the strap at the first stationary eyelet frame; and an embellishment coupled to a second, sliding eyelet frame, wherein the second, sliding eyelet frame is configured to slide over the first stationary eyelet frame and seat around an outer perimeter of the first stationary eyelet frame and wherein the post has a length configured to extend through the first stationary eyelet frame and second sliding eyelet frame sufficiently to allow a user to attach the backing element to the post.

2. The system of claim 1, wherein the head has a round dome shape that comprises a notch for twisting the backing element, and wherein the notch is about the width of a penny.

3. The system of claim 1, wherein the first stationary eyelet frame defines a substantially square shaped hole in the strap.

4. The system of claim 3, wherein the strap comprises a first side and a second side.

5. The system of claim 4, wherein at least a portion of the post of the decorative top is configured to pass through the hole.

6. The system of claim 5, wherein the ornament is configured to contact the first side and the backing element is configured to contact the second side, and wherein the decorative top is retained on the strap.

7. The system of claim 1, wherein the ornament is at least one of a jewel, an acrylic stone, a bead, a butterfly, a button, a charm, a letter, a number, a phrase, a symbol, a shape, a rhinestone, a feather, and ribbon.

8. A customizable sandal, comprising;

a sole;

a strap coupled to the sole;

a thong coupled to the strap and the sole;

an eyelet coupled to and defining an attachment point in the strap, wherein a non-elliptical stationary frame surrounds the eyelet;

an ornament comprising a decorative element coupled to a post, wherein the post is non-elliptical in shape, wherein engagement between the non-elliptical stationary frame and the post minimizes rotation of the ornament;

an embellishment comprising a sliding eyelet frame configured to slide over and seat around an outer perimeter of the non-elliptical stationary frame of the eyelet that is coupled to the strap; and a backing element threadably engaged with the post, wherein a head of the backing element comprises a dome shape having a notch for twisting the backing element, wherein the notch is approximately the width of a penny, wherein the post coupled to the decorative element has a length configured to extend through the non-elliptical stationary frame of the eyelet coupled to the strap and the sliding eyelet frame of the embellishment sufficiently to allow a user to attach the backing element to the post.

9. The sandal of claim 8, wherein the backing element is configured to removably attach the ornament to the strap at the attachment point.

10. The sandal of claim 9, wherein the post of the ornament is configured to pass through the eyelet at the attachment point.

11. The sandal of claim 8, wherein the ornament is at least one of a butterfly, a charm, a symbol, a shape, a rhinestone, a feather, and ribbon.

12. The sandal of claim 8, wherein the attachment point is a hole defined by the eyelet in the strap.

13. The sandal of claim 12, wherein the eyelet is at least one of a prong eyelet, an eyelet, a screw eyelet, a grommet, a screw grommet, a snap, a screw rivet, a hollow rivet, a rivet, a button hole, a button, a cut out shape, a threaded hole, and a hollow opening.

14. A method for customizing footwear, comprising:

providing a sandal comprising a strap having an attachment point;

providing a plurality of decorative elements, wherein each decorative element comprises an ornament coupled to a post and a backing element, wherein the post has an external dimension having a non-circular shape and wherein the backing element threadably engages the post;

providing a plurality of embellishments having a sliding eyelet comprising a non-circular shape corresponding to the non-circular shape of the external dimension of the post;

selecting a first decorative element from the plurality of decorative elements and a first embellishment from among the plurality of embellishments;

seating the sliding eyelet of the first embellishment around an outer perimeter of an opening in the attachment point of the sandal strap, the opening in the attachment point of the sandal strap having a non-circular shape that corresponds to the non-circular shape of the external dimension of the post and the sliding eyelet of the embellishment;

passing the post of the first decorative element through an internal portion of the attachment point around which the sliding eyelet of the first embellishment is attached, wherein the opening of the attachment point of the sandal strap engages the external dimension of the post of the first decorative element to prevent twisting of the first decorative element; and inserting a penny into a notch in the backing element of the first decorative element and applying a torque to the backing element of the first decorative element to threadably engage the backing element with the post of the first decorative element.

15. The method of claim 14, wherein the attachment point is configured to removably receive the post, such that a portion of the post at least partially protrudes through the strap.

* * * * *